US008985811B2

(12) United States Patent
Huang et al.

(10) Patent No.: US 8,985,811 B2
(45) Date of Patent: Mar. 24, 2015

(54) LED LUMINAIRE

(75) Inventors: Jen-Min Huang, Hsinchu (TW); Chih-Lung Liang, Taipei (TW)

(73) Assignees: Lite-On Electronics (Guangzhou) Limited, Guangzhou (CN); Lite-On Technology Corporation, Taipei (TW)

( * ) Notice: Subject to any disclaimer, the term of this patent is extended or adjusted under 35 U.S.C. 154(b) by 844 days.

(21) Appl. No.: 13/074,249

(22) Filed: Mar. 29, 2011

(65) Prior Publication Data

US 2011/0292652 A1 Dec. 1, 2011

(30) Foreign Application Priority Data

May 31, 2010 (CN) ..... 2010 1 0186560

(51) Int. Cl.

| | |
|---|---|
| ***F21S 4/00*** | (2006.01) |
| ***F21V 21/00*** | (2006.01) |
| ***F21V 5/00*** | (2006.01) |
| *F21K 99/00* | (2010.01) |
| *F21V 29/00* | (2006.01) |
| *F21Y 101/02* | (2006.01) |
| *F21Y 103/00* | (2006.01) |

(52) U.S. Cl.

CPC ..... *F21V 5/008* (2013.01); *F21V 5/002* (2013.01); *F21K 9/00* (2013.01); *F21S 4/003* (2013.01); *F21V 29/22* (2013.01); *F21V 29/246* (2013.01); *F21Y 2101/02* (2013.01); *F21Y 2103/003* (2013.01)

USPC ..... 362/249.02; 362/217.01; 362/335; 362/555; 362/246; 362/270

(58) Field of Classification Search

CPC ..... F21Y 2101/02; F21Y 2103/003; F21Y 2103/00; F21V 5/04; F21V 19/001; G01N 21/64; Y10S 362/80; F21K 9/10; F21S 4/008

USPC ..... 362/268, 334, 335, 235, 236, 240, 246, 362/249.02, 270, 336–340, 347, 169, 11, 362/311.01, 613, 311.02, 612, 84, 217.01, 362/555, 310

See application file for complete search history.

(56) References Cited

U.S. PATENT DOCUMENTS

| | | | | |
|---|---|---|---|---|
| 2004/0080835 | A1* | 4/2004 | Chinniah et al. | 359/708 |
| 2008/0088770 | A1* | 4/2008 | Hwang et al. | 349/64 |
| 2011/0103053 | A1 | 5/2011 | Chen et al. | |

* cited by examiner

*Primary Examiner* — Stephen F Husar
*Assistant Examiner* — Danielle Allen
(74) *Attorney, Agent, or Firm* — Li & Cai Intellectual Property (USA) Office

(57) ABSTRACT

A LED luminaire includes a body portion having a lighting module and an optical structure formed integrally with the body portion. The optical structure is formed within the body portion and located in a light-projection direction of the lighting module. The optical structure substantially is a sheet-like structure with a first surface and a second surface. The first surface has at least two side portions with a first curvature, and the second surface has a second curvature. The first curvature is greater than the second curvature. Thereby, the view angle of the light is increased as the light generated from the lighting module passes through the optical structure.

19 Claims, 8 Drawing Sheets

LED LUMINAIRE

BACKGROUND OF THE INVENTION

1. Field of the Invention

The present invention relates to a LED luminaire, and more particularly, to a LED luminaire with wide view angle.

2. Description of Related Art

LEDs are widely used in lighting application, such as in various luminaire. For example, the luminaire may be a tube, a bulb or a down light, etc.

The view angle of the traditional LED is about 120 degrees. Due to the small view angle, just as the tube for example, the tube using the traditional LED module has smaller view angle than the fluorescent tube in the transverse direction perpendicular to the tube shaft. Furthermore, multiple LEDs are arranged along the tube shaft and a dark area occurs between the adjacent LEDs because of the small view angle. Therefore, the regions of high light density and low light density are occurred alternatively in the longitudinal direction of the tube shaft (i.e., hot spot). The viewers may feel uncomfortable in vision due to the hot spot phenomenon.

Currently, some manufacturers have used smaller LEDs on the printed circuit board. By decreasing the distance between adjacent LEDs, the low light density area is reduced for solving the hot spot problem in the longitudinal direction of the tube shaft. However, the problem of the small view angle in the transverse direction cannot be solved by using smaller LEDs.

To overcome the above issues, the inventor proposes a solution as described below.

SUMMARY OF THE INVENTION

The objective of the present invention is to provide a LED luminaire, which is characterized by a two-layer structure that can be formed by a co-extrusion method. The two-layer structure includes a body portion and an optical structure. The optical structure substantially is a sheet-like structure with two surfaces not parallel to each other. Two refractions occur as the light passes through the optical structure, such that the light can project in larger angles and increase the view angle accordingly.

The present invention offers the following advantages. The body portion and the optical structure could be made by the same or different plastic material. Next, a co-extrusion process could be used to produce the body portion and the optical structure integrally. No additional assembly is needed, which increases the efficiency of manufacturing process. Furthermore, the light is refracted twice by passing through the two non-parallel surfaces (i.e., the first and second surface) of the optical structure to increase the projection angle of the lighting module, such that the view angle of the lighting module is increased.

In order to further appreciate the characteristics and technical contents of the present invention, references are hereunder made to the detailed descriptions and appended drawings in connection with the present invention. However, the appended drawings are merely shown for exemplary purposes, rather than being used to restrict the scope of the present invention.

DETAILED DESCRIPTION

Figure 1:
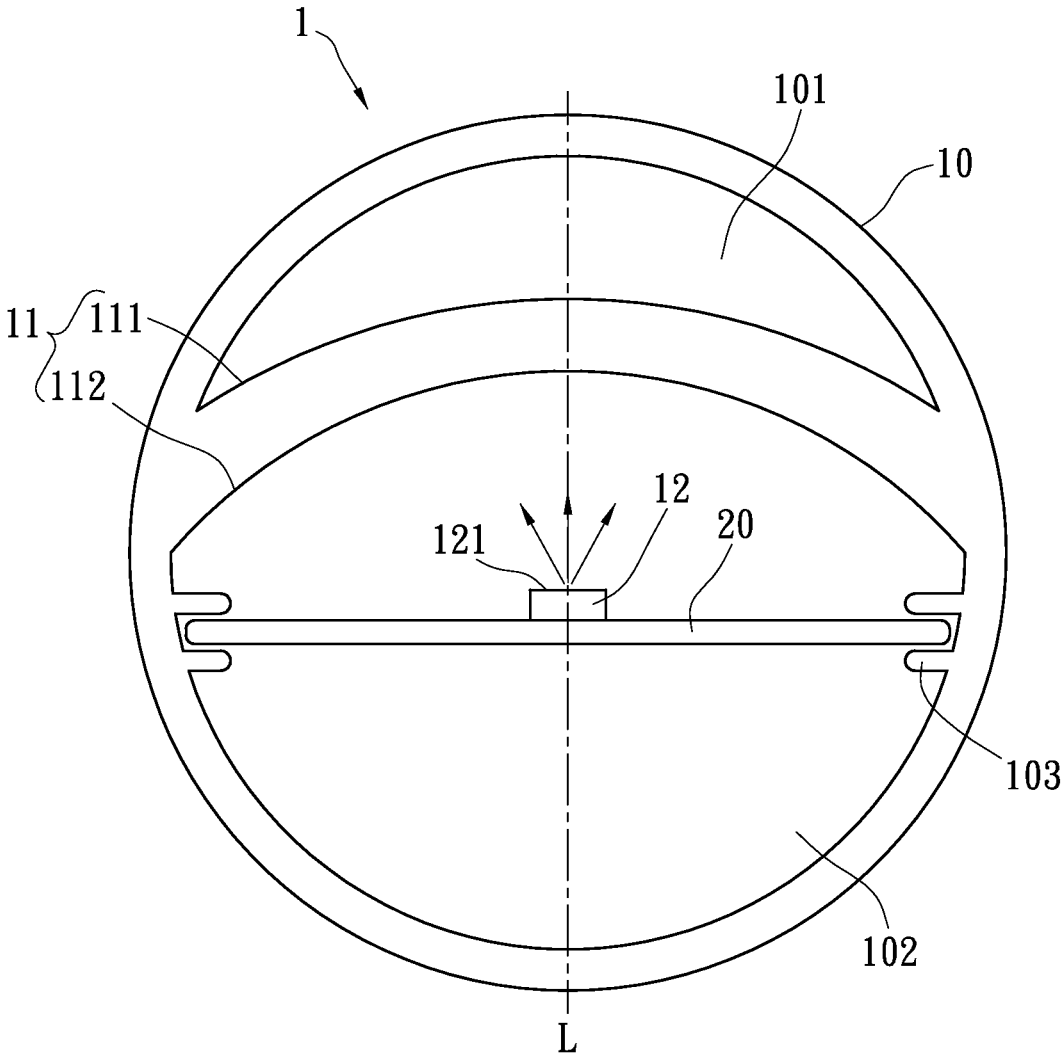
FIG. 1 shows a cross-sectional view of the LED luminaire of a first embodiment according to the present invention.

Hereinafter the present invention is described in the following embodiments shown in the drawings and the same reference number is designated to represent the similar element.

The present invention provides a LED luminaire that has a body portion and an optical structure, and the body portion and the optical structure are manufactured integrally by a co-extrusion process. The optical structure is used to generate two refractions when the light passes through the optical structure, so as to increase the view angle of the lighting module assembled in the LED luminaire of the present invention. The embodiments of the LED luminaire in the present invention are described with the LED tubes, but not limited thereby. The luminaire of the present invention may be a LED bulb, down light or any other types of the lighting device. As the LED bulb for example, the optical structure is a sheet-like structure formed within the body portion of the LED bulb along the lamp cover. As the LED tube for example, the body portion is a tubular element with an opening at both ends, and the optical structure is a sheet-like structure formed within the body portion of the LED tube.

The following drawings are cross-sectional views along the transverse axis perpendicular to the body portion.

Please refer to FIG. 1; the LED luminaire 1 of the first embodiment is shown, and the LED luminaire 1 at least has a body portion 10 and an optical structure 11. A lighting module 12, for example a LED chip, is located in the body portion 10. In the present embodiment, the lighting module 12 may be fixed on the upper surface of a heat-dissipating element 20. The heat-dissipating element 20 may be formed by an aluminum-extrusion method and is used for dissipating heat generated from the lighting module 12. In addition, the heat-dissipating element 20 may be electrically connected to different circuit boards (not shown), for example, a LED control circuit board or a drive circuit board, and the circuit boards may be mounted on the heat-dissipating element 20. Therefore, the heat-dissipating element 20 is further provided for dissipating heat generated from the circuit boards.

The optical structure 11 is formed integrally with the body portion 10. For example, the extrusion technology for forming polymers into plastic products is used for manufacturing the body portion 10 and the optical structure 11 integrally. Depending on the optical and physical properties, a single polymer, for example polycarbonate (PC) or poly methylmethacrylate (PMMA), is used for manufacturing the body portion 10 and the optical structure 11. Alternatively, at least two polymers, for example polycarbonate (PC) and poly methylmethacrylate (PMMA), are used to form the body portion 10 and the optical structure 11 by the co-extrusion method. For example, the PC material can be the product type with LN-2250Z available from Teijin. The PC material has high strength, low moisture absorption (i.e., the moisture absorption is about 2%), high flame-retarding property (V-0 degree), and small deformation (i.e., shrinkage ratio is about 0.5% to 0.7%). Moreover, the transparency of LN-2250Z is about 88%. On the other hand, the PMMA material can be the product type with CM-205, CM-207, or CM-211 available from CHI MEI CORPORATION. The PMMA material has moisture absorption of 3% and transparency of 92%. The above-mentioned available products may be used in the present invention.

Moreover, in the LED luminaire 1 manufactured by the co-extrusion method, the optical structure 11 is formed inside the body portion 10 and located in the light-projection direction of the lighting module 12 (shown by arrows). The optical structure 11 is an arc-plate protruding along the light-projection direction of the lighting module 12. The optical structure 11 substantially has a first surface 111 and a second surface 112, and the two surfaces 111, 112 are not parallel to each other. As shown in FIG. 1, the first surface 111 is farther from the lighting module 12 than the second surface 112. The first surface 111 has larger curvature than that of the second surface 112, and the curvature of the first surface 111 can be smaller or equal to the curvature of a straight line (i.e., the curvature of a straight line is infinite). Because of the curvature difference between the two surfaces 111, 112, the light generated from the lighting module 12 is initially refracted by the second surface 112, followed with another refraction by the first surface 111. Due to the two refractions, the view angle of the light generated from the lighting module 12 can be increased after passing through the first surface 111 and the second surface 112 of the optical structure 11.

Figure 2A:
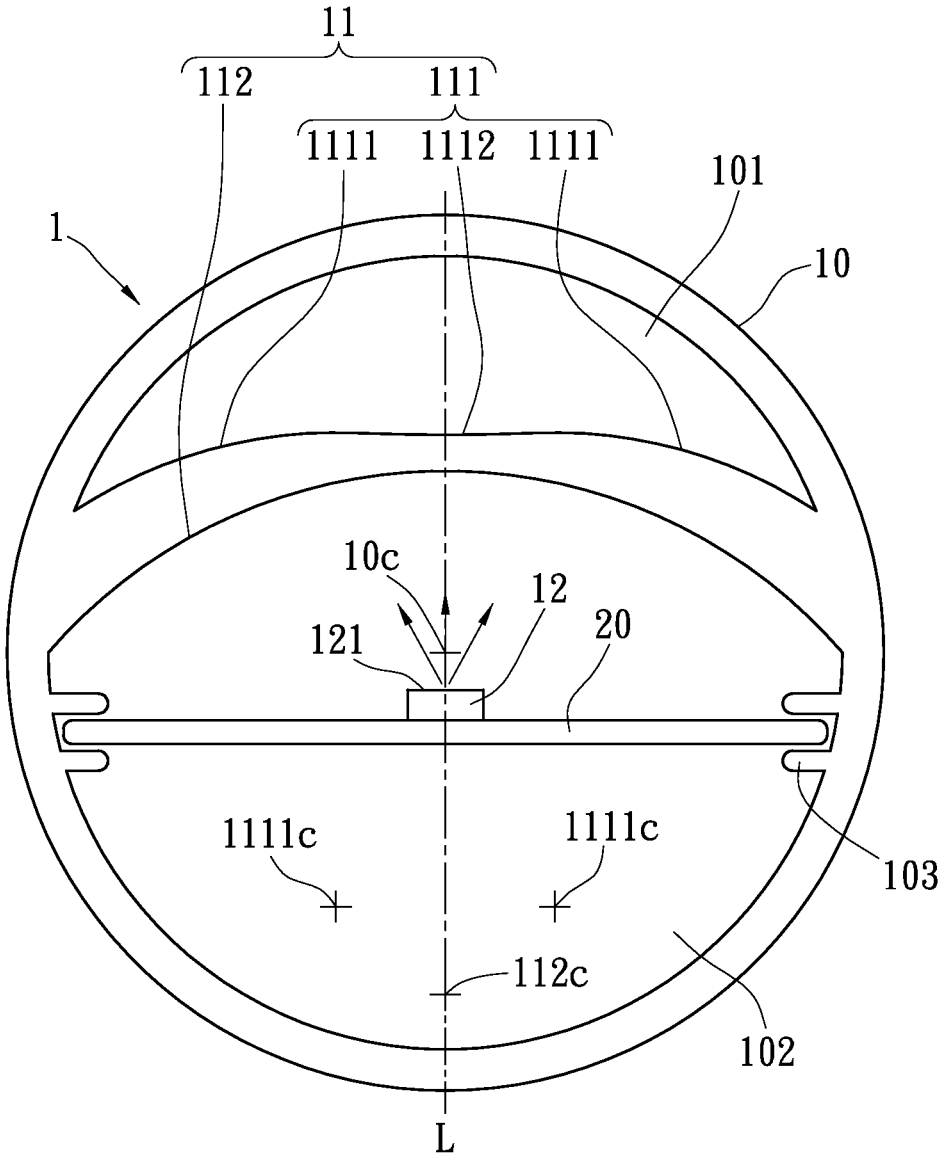
FIG. 2A shows a cross-sectional view of the LED luminaire of a second embodiment according to the present invention.
Figure 2B:
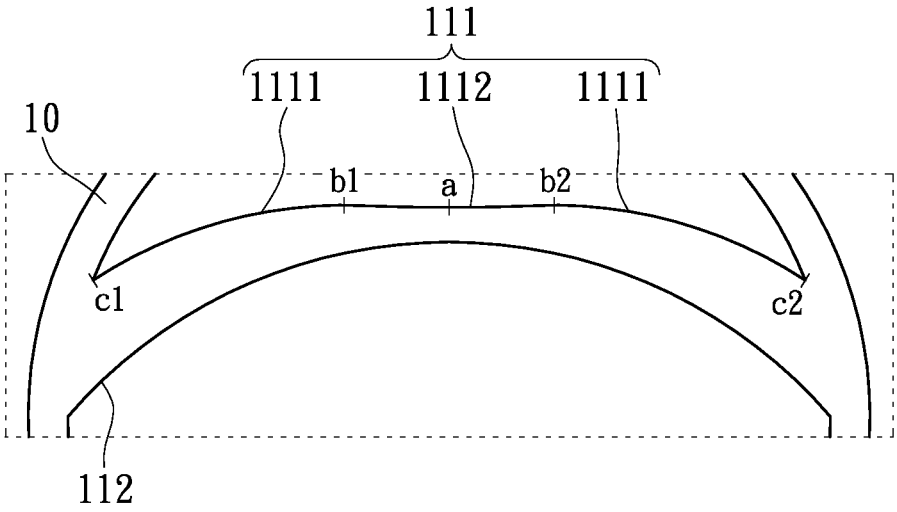
FIG. 2B shows a part of the optical structure of FIG. 2A.
Figure 2C:
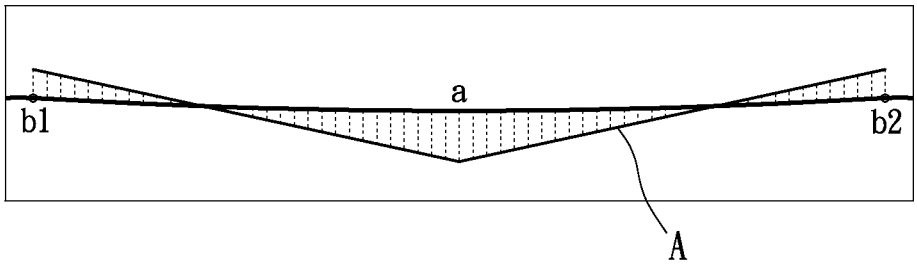
FIG. 2C shows the curvature of the middle portion of the optical structure according to the second embodiment of the present invention.

Please refer to FIGS. 2A to 2C; the second embodiment of the present invention is shown. Different from the first embodiment, the second embodiment's first surface 111 has at least two side portions 1111 and a middle portion 1112 arranged between the two side portions 1111. Namely, the first surface 111 has modified structures to increase the view angle of the light produced by the lighting module 12. In FIG. 2B, one side portion 1111 is defined by the connection of an end point "b1" (i.e., the end point in connection of the middle portion 1112) and an end point "c1" (i.e., the end point in connection with the body portion 10), and the other side portion 1111 is defined by the connection of an end point "b2" (i.e., the end point in connection of the middle portion 1112) and an end point "c2" (i.e., the end point in connection with the body portion 10). In other words, the two side portions 1111 can be represented by section of "b1*c*1" and "b2*c*2". The middle portion 1112 is defined by connection of the end point "b1" and the end point "b2", and can be represented by section of "b1*b*2". In the present embodiment, the two side portions 1111 have a first curvature, and the first curvature is greater than the second curvature of the second surface 112. For example, in the present embodiment, the radius of the body portion 10 is 17.25 mm, and the radius of the side portions 1111 of the optical structure 11 is 19.12 mm. The radius of the second surface 112 of the optical structure 11 is 20.45 mm. Based on the definition of the curvature, which is equal to the reciprocal of the radius; the first curvature is calculated to be greater than the second curvature, and the first curvature is smaller than the curvature of a straight light.

In addition, the middle portion 1112 can be an arc surface with a plurality of continuous curvatures (i.e., the spline). As shown in FIG. 2C; the line A of FIG. 2C represents the curvature change of the spline of the present embodiment. The end points of "a", "b1", and "b2" correspond to the middle portion 1112 shown in FIG. 2B. Symmetric at end point "a", the curvature of the spline changes linearly from end point "a" to end point "b1" and to end point "b2". In an exemplary embodiment, the coordinate of end point "a" is (0, 8.608), and the coordinates of end point "b1", "b2" are respectively (−3.5, 8.712) and (3.5, 8.712). Therefore, the width of the middle portion 1112 is 7 mm. However, the width of the middle portion 1112 can be different depending on the size of the lighting module 12. Dimensionally, the width of the middle portion 1112 ranges from half to three times of the size of the lighting module 12. Therefore, by combining the structural variation of the side portions 1111 and the middle portion 1112, the view angle of the light is increased and improves the uniformity of light projection. Furthermore, the thickness of each of the side portions 1111 is greater than that of the middle portion 1112.

Please refer to FIG. 2A again. For the second embodiment of the present invention, the second surface 112 of the optical structure 11 has a circular center 112C and the body portion 10 has a circular center 10C (i.e., a core). The circular centers 10C, 112C are coaxial and are located on the same light axis "L". The two side portions 1111 are arc-surfaces with the same curvature but have different circular centers 1111*c* (i.e., two circular centers are shown in FIG. 2A). The circular centers 1111*c* of the two side portions 1111 are symmetric to the light axis "L," which is coaxial with the axis defined by the circular centers 10C, 112C.

Figure 3:
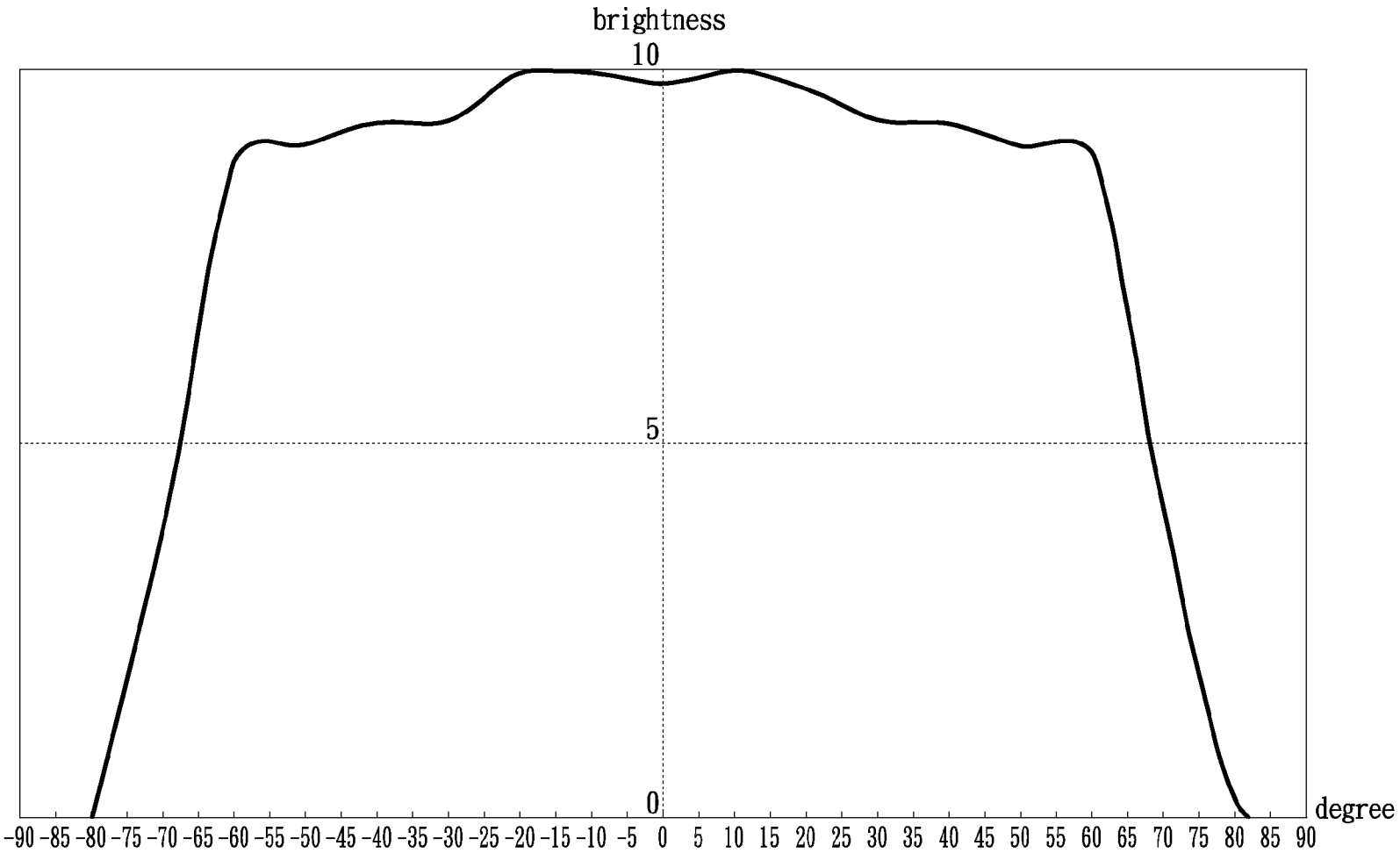
FIG. 3 shows the light shape of the second embodiment according to the present invention.

With reference to FIG. 1 and FIG. 2A, the LED luminaire 1 has two accommodating rooms thereinside. The first accommodating room 101 is constructed by the first surface 111 of the optical structure 11 and the inner surface of the body portion 10. The second accommodating room 102 is constructed by the second surface 112 of the optical structure 11 and the inner surface of the body portion 10. The body portion 10 of the LED luminaire 1 further has a first fixing portion 103 in the second accommodating room 102 for holding the heat-dissipating element 20. The lighting module 12 may be mounted on the heat-dissipating element 20. The light generated from the lighting module 12 projects to and passes through the first surface 111 and the second surface 112 to increase the view angle of the LED luminaire 1. Furthermore, with the structural variations of the first surface 111 as shown in FIG. 2A, the light projected from the lighting module 12 is more uniform as well as an increase of the view angle of the LED luminaire 1. Please refer to FIG. 3; the light shape of the lighting module 12 that is mounted in the second embodiment is shown. The figure shows the view angle has increased to approximately 140 degrees, which improves the projection ability of light generated by LED.

Specifically, the position of the optical structure 11 in the LED luminaire is defined as follows. The distance between the optical structure 11 and the lighting module 12 can be zero, so the second surface 112 of the optical structure 11 contacting the lighting emitting surface 121 (i.e., top surface) of the lighting module 12. The distance between the optical structure 11 and the lighting module 12 can be as zero to two-thirds of the distance defined by the lighting emitting surface 121 of the lighting module 12 and the inner surface of the body portion 10 in the direction of the light axis L. In other words, the position of the optical structure 11 may be preferably located in zero to two-thirds of the distance between the lighting emitting surface 121 of the lighting module 12 and the body portion 10 in the direction of light axis L. In addition, to minimize the effect of heat generated by the lighting module 12 on the optical structure 11, a space is recommended between the lighting module 12 and the optical structure 11 and the space is preferred greater than 1 mm in the direction of the light axis L.

Figure 4:
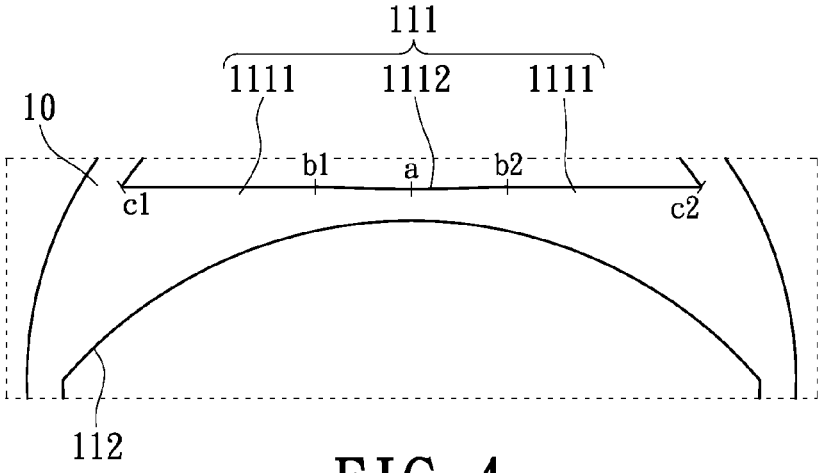
FIG. 4 shows an alternative of the second embodiment according to the present invention.

Please refer to FIG. 4; a modification of the second embodiment is shown. The first curvature of the two side portions 1111 are equal to the curvature of a straight line (i.e., the curvature of a straight line is infinite). The connection of the end point "b1" (i.e., the first end point in connection to the middle portion 1112) and the end point "c1" (i.e., the second end point in connection to the body portion 10) is a straight line. The connection of the end point "b2" (i.e., the end point in connection to the middle portion 1112) and the end point "c2" (i.e., the end point in connection with the body portion 10) is also a straight line. In other words, for the side portions 1111, the position of each of end points connecting to the body portion 10 (so-called as the first end point) is equal to or lower than a position of each of the end points connecting to the middle portion 1112 (so-called as the second end point). In terms of optical design, the position of end point "c1" (the first end point) is equal to or lower than that of end point "b1" (the second end point), and the position of end point "c2" (also the first end point) is equal to or lower than that of end point "b2" (also the second end point). Under the condition that the first curvature must be larger than the second curvature, the curvature of the two side portions 1111 (i.e., the sections b1*c*1 and b2*c*2) is equal to or smaller than the curvature of a horizontal line.

Figure 5:
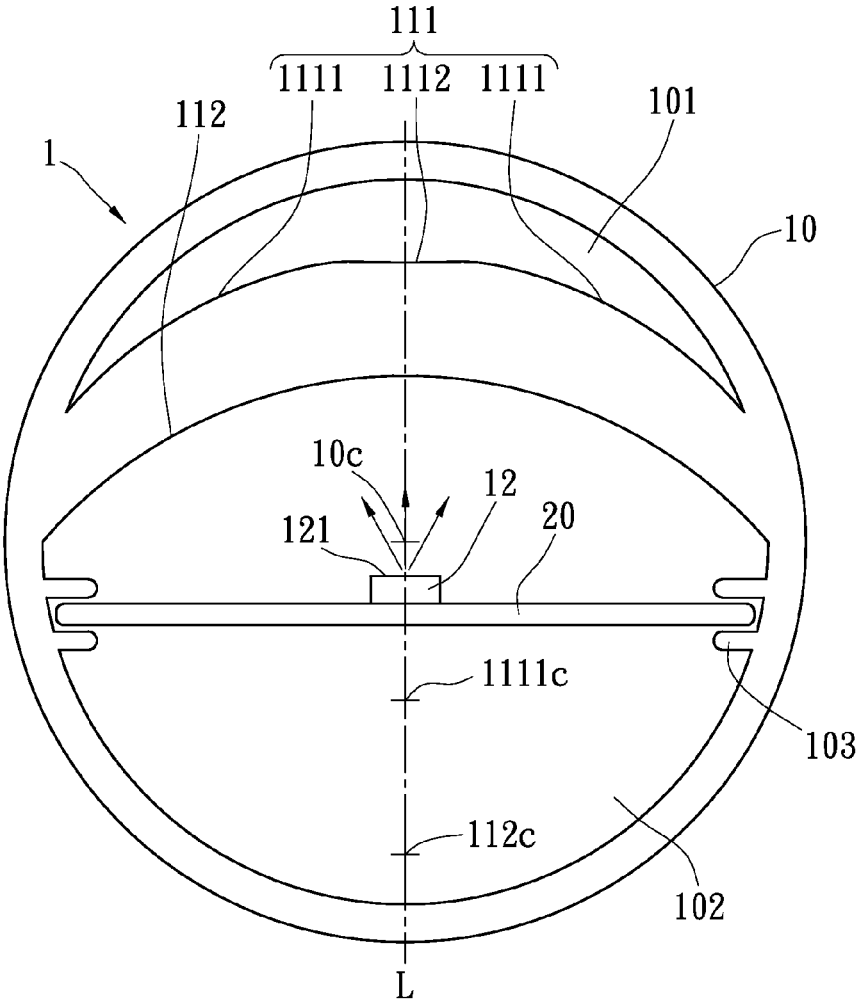
FIG. 5 shows another alternative of the second embodiment according to the present invention.

Please refer to FIG. 5; another modification of the second embodiment is shown. The side portions 1111 are arc-surfaces with the same circular center (i.e., circular center 1111C). In other words, the side portions 1111 are two portions which can be substantially connected as a circle. In the exemplary embodiment, the side portions 1111 have the same circular center as the circular center 1111C.

Furthermore, the lighting module 12 may be located in a lower position in the second accommodating room 102 of the body portion 10. The resultant distance between the optical structure 11 and the lighting module 12 is within the allowable distance in the preceding description.

Figure 6:
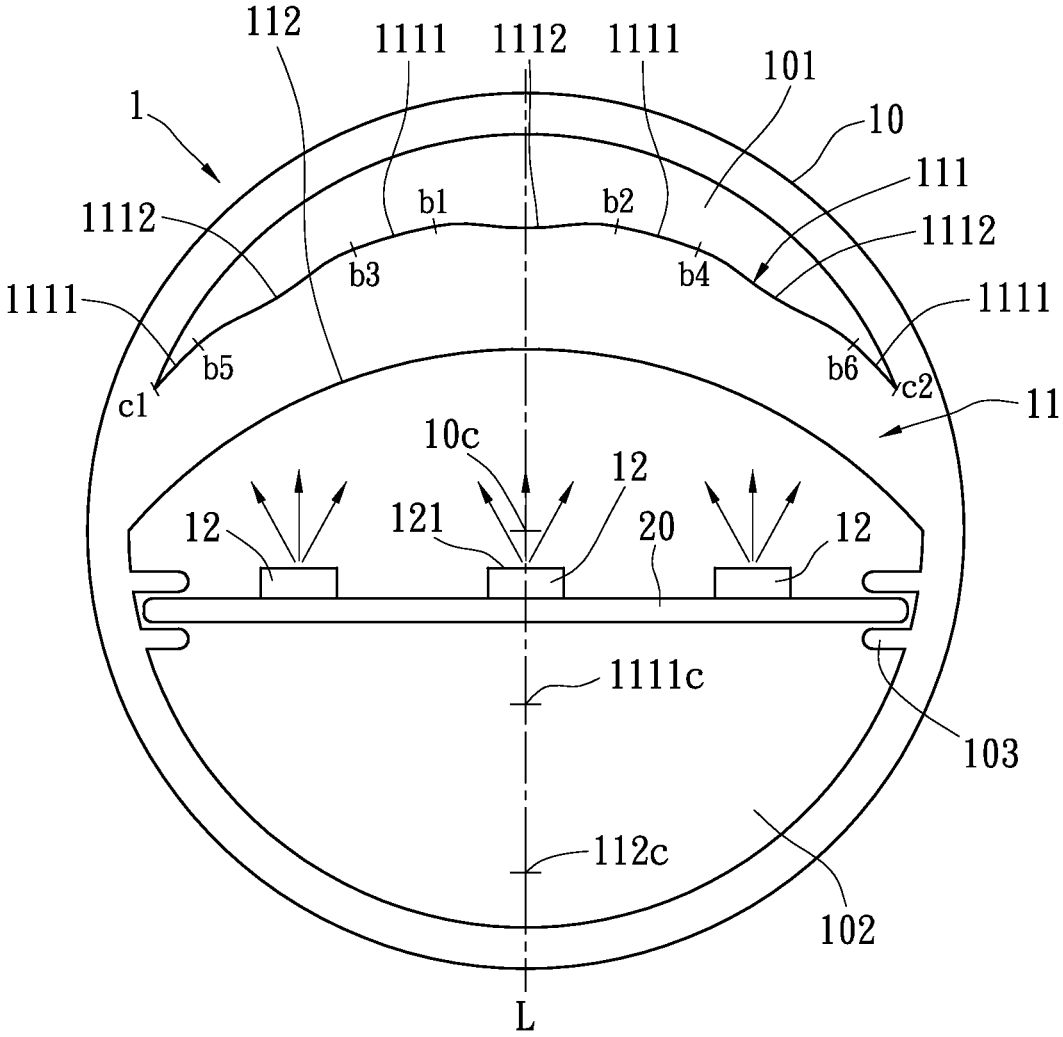
FIG. 6 shows an alternative of the embodiment of FIG. 5.

Please refer to FIG. 6; a modification of the embodiment of FIG. 5 is shown. Three lighting modules 12 are placed on the heat-dissipating element 20. The first surface 111 of the optical structure 11 has three middle portions 1112 of spline corresponding to the three lighting modules 12 respectively. For example, the left lighting module 12 corresponds to the middle portion 1112 of "b3*b*5" section. The middle portions 1112 have the same width with the middle portion 1112 of the second embodiment. Therefore, the body portion 10 can hold a plurality of lighting module 12 therein. The first surface 111 of the optical structure 11 can have a plurality of side portions 1111 (i.e., the sections c1*b*5, b3*b*1, b2*b*4, and b6*c*2) and a plurality of middle portions 1112 (i.e., the sections b5*b*3, b1*b*2, and b4*b*6). The width of each middle portion 1112 is ranged from one half up to three times of the corresponding lighting module 12. For the present modification, the side portions 1111 are arc-surfaces with the same circular center 1111*c*. In other cases, the side portions 1111 are arc-surfaces with the same curvature but have different circular centers. Alternatively, the side portions 1111 can be classified in two groups: the side portions 1111 at left portion of the light axis "L" and the side portions 1111 at right portion of the light axis "L". The side portions 1111 at left portion of the light axis "L" have a circular center and the side portions 1111 at right portion of the light axis "L" have another circular center. Moreover, the two circular centers are symmetrical of the light axis "L". All the above modifications are part of the present invention.

Figure 7:
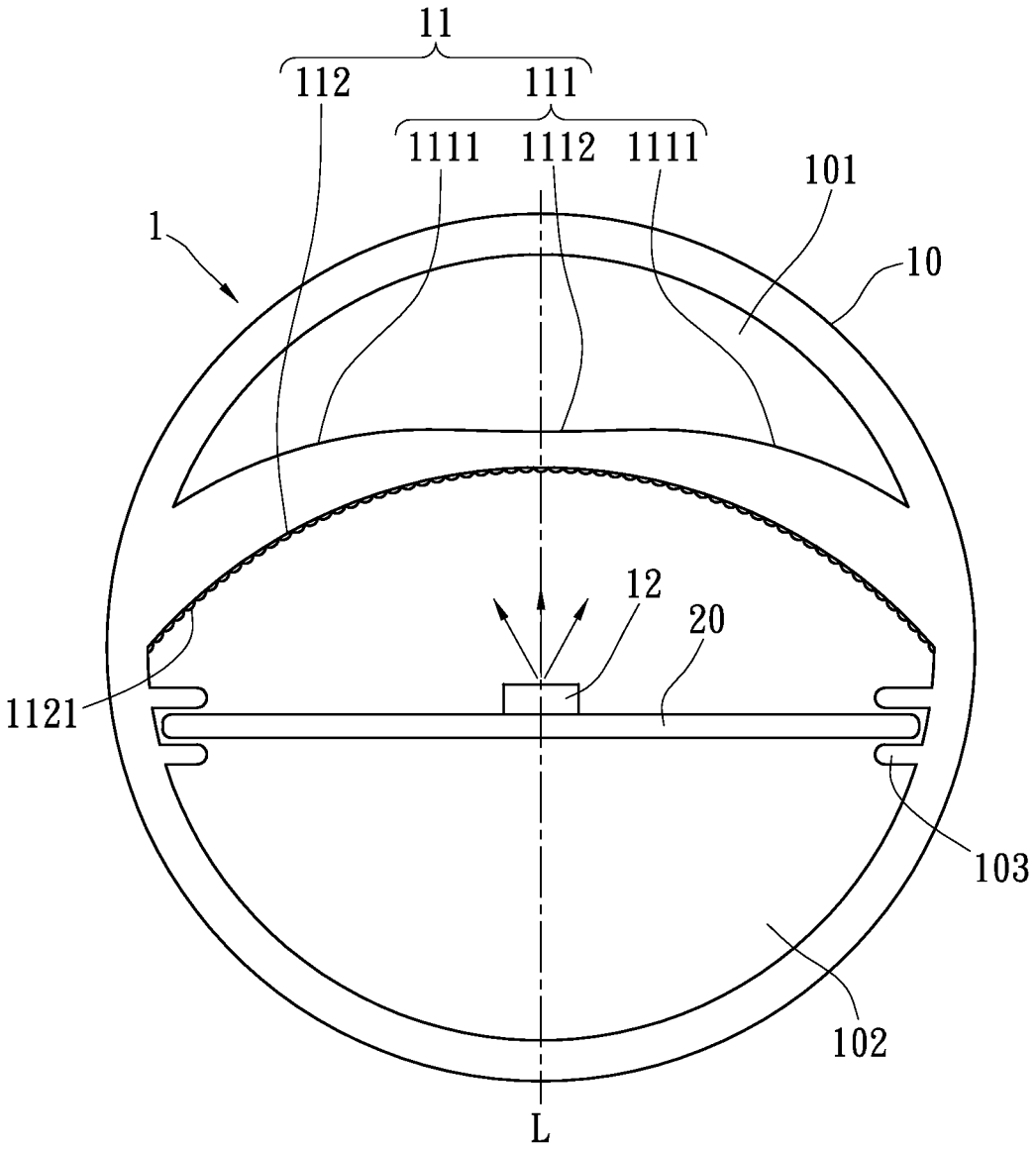
FIG. 7 shows a cross-sectional view of the LED luminaire of a third embodiment according to the present invention.

Please refer to FIG. 7; the third embodiment is shown. The optical structure 11 is formed inside the body portion 10 and located in the light-projection path of the lighting module 12. The optical structure 11 substantially has a first surface 111 and a second surface 112, and the two surfaces 111, 112 are not parallel to each other. The first surface 111 consists with two side portions 1111 and a middle portion 1112 between the two side portions 1111. In the present embodiment, the optical structure 11 or the light-projecting area of the body portion 10 may have optical micro-structure thereon for improving the light uniformity. As shown in FIG. 7, the second surface 112 of the optical structure 11 has a plurality of convex portion 1121 of the optical micro-structure 112, and the convex portions 1121 may be formed integrally with the optical structure 11 and the body portion 10 by the co-extrusion method. Therefore, the view angle of the LED luminaire is increased and the convex portions 1121 of the optical micro-structure are used to improve light uniformity.

Figure 8:
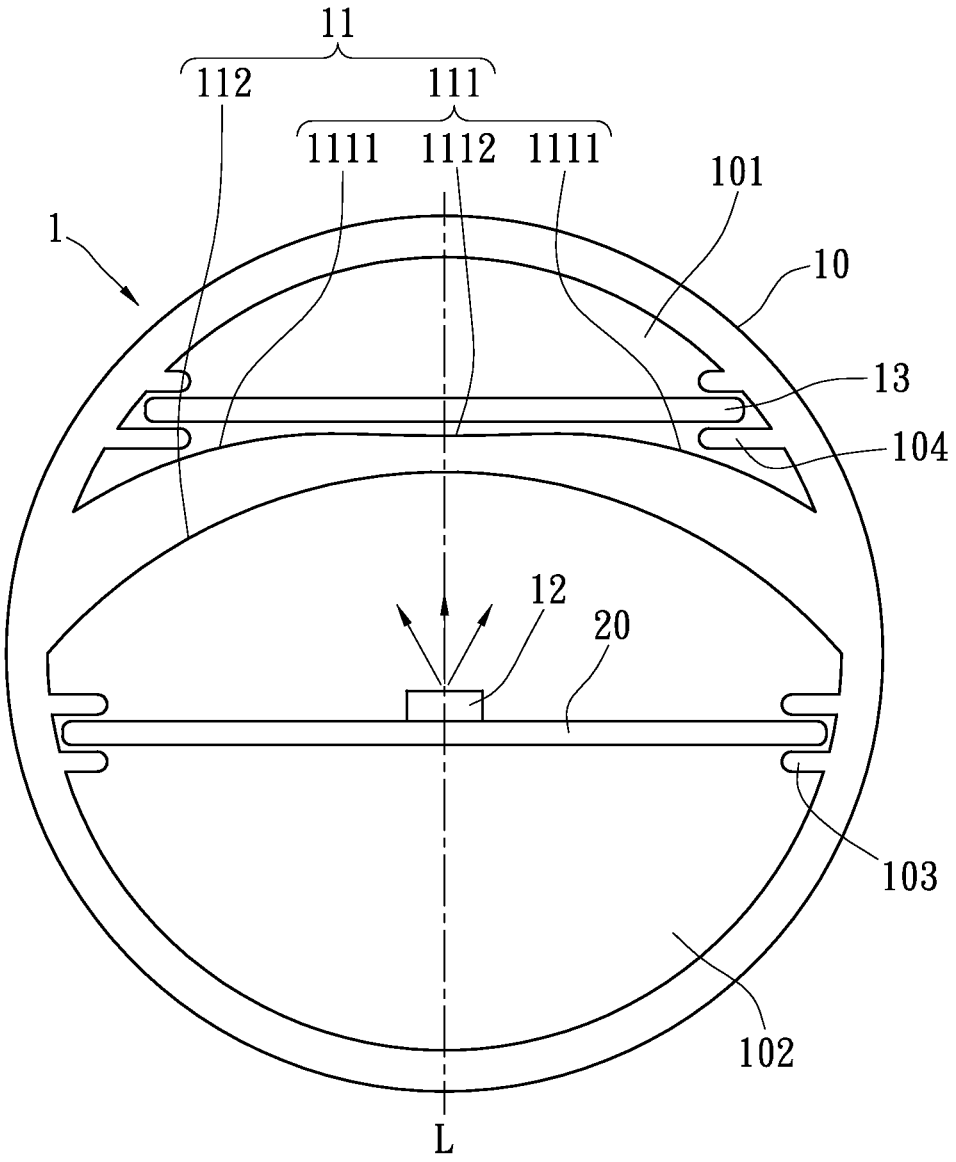
FIG. 8 shows a cross-sectional view of the LED luminaire of a fourth embodiment according to the present invention.

Please refer to FIG. 8; the fourth embodiment is shown. The optical structure 11 is formed inside the body portion 10 and located in the light projection path of the lighting module 12. The optical structure 11 substantially has a first surface 111 and a second surface 112, and the two surfaces 111, 112 are not parallel to each other. The first surface 111 consists with two side portions 1111 and a middle portion 1112 in between the two side portions 1111. In the present embodiment, the body portion 10 further has a second fixing portion 104 in the first accommodating room 101 for assembling an optical element 13. The optical element 13 may be a diffuser sheet or a brightness enhancement film. Therefore, the view angle of the LED luminaire is increased and the optical element 13 can be used to improve light uniformity.

Based on the above descriptions, the present invention can offer one or more advantages as below.

1. The co-extrusion method is used to form the optical structure integrally with the body portion. The optical structure has a first surface and a second surface, and the two surfaces are not parallel to each other, such that the light passes through the two surfaces is refracted to increase the view angle of the LED luminaire. Specifically, the view angle for the LED tube is increased in the transverse direction perpendicular to the tube shaft of the body portion.

2. The view angle of the LED luminaire can be increased also. Therefore, the structure of the present invention can be used to solve the hot spot issue when using LEDs with the same size 3. To improve the uniformity of light generated by LED, the present invention uses the co-extrusion method to form the micro-structure, such as the convex portions on the bottom surface of the optical structure. In addition, other surface modifications to the optical structure and the addition of auxiliary optical elements also contribute to the improvement.

The descriptions illustrated supra set forth simply the preferred embodiments of the present invention; however, the characteristics of the present invention are by no means restricted thereto. All changes, alternations, or modifications conveniently considered by those skilled in the art are deemed to be encompassed within the scope of the present invention delineated by the following claims.

What is claimed is:

1. A LED luminaire comprising:

a body portion having at least one lighting module therein; and an optical structure formed within the body portion and located in a light-projection direction of the lighting module, the optical structure substantially being a sheet-like structure with a first surface and a second surface;

wherein the first surface has at least two side portions with a first curvature, the second surface has a second curvature, and the first curvature is greater than the second curvature so that the optical structure is provided for increasing view angle of light generated from the lighting module;

wherein a circular center defined by the second surface and a core center of the body portion are coaxial.

2. The LED luminaire according to claim 1, wherein the first surface is farther from the lighting module than the second surface, the optical structure further has a middle portion between the two side portions, and the middle portion is corresponding to the lighting module.

3. The LED luminaire according to claim 2, wherein the middle portion is an arc surface with a plurality of continuous curvatures.

4. The LED luminaire according to claim 2, wherein the middle portion has a width ranged from one half to three times of a size of the lighting module.

5. The LED luminaire according to claim 2, wherein each side portion has a first end in connection with the body portion and a second end in connection with the middle portion.

6. The LED luminaire according to claim 5, wherein a position of each of the first end points is equal to or lower than a position of each of the second end points in connection of the middle portion, and the first curvature is equal to or smaller than a curvature of a straight line.

7. The LED luminaire according to claim 1, wherein the side portions are arc-surfaces formed by a plurality of arc-surfaces with the same circular center or with different circular centers.

8. The LED luminaire according to claim 1, wherein the second surface of the optical structure contacts with a lighting emitting surface of the lighting module.

9. The LED luminaire according to claim 1, wherein a distance between the optical structure and the lighting module is located in zero to two-thirds of a distance between a lighting emitting surface of the lighting module and an inner surface of the body portion in a direction of a light axis.

10. The LED luminaire according to claim 1, wherein a plurality of the lighting modules is disposed within the body portion, the first surface is farther from the lighting modules than the second surface in the light-projection direction, and the first surface has a plurality of middle portions corresponding to the lighting modules and a plurality of side portions located at two sides of the middle portions.

11. The LED luminaire according to claim 10, wherein each the middle portion has a width ranged from one half to three times of a size of the corresponding lighting module.

12. The LED luminaire according to claim 10, wherein the second surface further has an optical micro-structure and the optical micro-structure has a plurality of convex portions.

13. The LED luminaire according to claim 1, wherein the second surface further has an optical micro-structure and the optical micro-structure has a plurality of convex portions.

14. The LED luminaire according to claim 1, further comprising an optical element, wherein the optical element is located in a first accommodating room constructed by the first surface of the optical structure and an inner surface of the body portion, the lighting module is located in a second accommodating room constructed by the second surface of the optical structure and the inner surface of the body portion.

15. The LED luminaire according to claim 14, wherein the optical element is a diffusion sheet or a brightness enhancement film.

16. A LED luminaire, comprising:

a body portion having at least one lighting module therein; and an optical structure formed within the body portion and located in a light-projection direction of the lighting module, the optical structure substantially being a sheet-like structure with a first surface and a second surface, and the first surface and the second surface being not parallel to each other;

wherein the first surface is farther from the lighting module than the second surface, the curvature of the first surface is greater than the curvature of the second surface so that the optical structure is provided for increasing view angle of light generated from the lighting module;

wherein a circular center defined by the second surface and a core center of the body portion are coaxial.

17. The LED luminaire according to claim 16, wherein the second surface further has an optical micro-structure and the optical micro-structure has a plurality of convex portions.

18. The LED luminaire according to claim 16, wherein the optical structure further has a middle portion corresponding to the lighting module with a width ranged from one half to three times of a size of the lighting module.

19. The LED luminaire according to claim 16, wherein the optical structure comprises two side portions and a middle portion, the middle portion is disposed between the two side portions, and a thickness of each of the two side portions is greater than that of the middle portion.

* * * * *